US006713224B1

(12) United States Patent
Hill et al.

(10) Patent No.: US 6,713,224 B1
(45) Date of Patent: Mar. 30, 2004

(54) SOUND RECORDING FILM

(75) Inventors: Susan D. Hill, Rochester, NY (US); Vicky Sinn, Rochester, NY (US); Jean-Fabien Dupont, Chalon sur Saone (FR)

(73) Assignee: Eastman Kodak Company, Rochester, NY (US)

( * ) Notice: Subject to any disclaimer, the term of this patent is extended or adjusted under 35 U.S.C. 154(b) by 137 days.

(21) Appl. No.: 09/550,503

(22) Filed: Apr. 14, 2000

Related U.S. Application Data

(60) Provisional application No. 60/129,719, filed on Apr. 16, 1999.

(51) Int. Cl.[7] ..... G03C 1/76; G03C 1/825

(52) U.S. Cl. ..... 430/140; 430/510; 430/934

(58) Field of Search ..... 430/140, 934, 430/510

(56) References Cited

U.S. PATENT DOCUMENTS

| | | | | |
|---|---|---|---|---|
| 1,756,863 A | | 4/1930 | Hoxie | |
| 2,178,217 A | | 10/1939 | Baker | |
| 2,430,558 A | | 11/1947 | Carroll et al. | |
| 3,705,803 A | | 12/1972 | Bevis et al. | |
| 3,715,208 A | | 2/1973 | Lestina et al. | |
| 3,945,824 A | | 3/1976 | Sakai et al. | |
| 3,969,593 A | | 7/1976 | Vlahos | |
| 4,139,382 A | | 2/1979 | Stephens | |
| 4,208,210 A | | 6/1980 | Sakai et al. | |
| 4,216,284 A | | 8/1980 | Sakai et al. | |
| 4,430,422 A | | 2/1984 | Van de Sande et al. | |
| 4,461,552 A | | 7/1984 | Levine | |
| 4,553,833 A | | 11/1985 | Kanaoka et al. | |
| 4,600,280 A | | 7/1986 | Clark | |
| 4,839,267 A | | 6/1989 | Monbaliu et al. | |
| 4,940,654 A | * | 7/1990 | Diehl et al. | 430/522 |
| 5,283,164 A | | 2/1994 | Fenton et al. | |
| 5,356,764 A | | 10/1994 | Szajewski et al. | |
| 5,587,749 A | | 12/1996 | Goldberg et al. | |
| 5,639,585 A | | 6/1997 | Callahan, Jr. et al. | |
| 5,709,983 A | * | 1/1998 | Brick et al. | 430/519 |
| 5,723,272 A | | 3/1998 | Barber et al. | |
| 5,955,255 A | | 9/1999 | Gerlach et al. | |
| 5,962,207 A | * | 10/1999 | Anderson et al. | 430/517 |

FOREIGN PATENT DOCUMENTS

| | | |
|---|---|---|
| DE | 43619 | 12/1965 |
| DE | 2459927 | 12/1974 |
| EP | 304297 | 2/1989 |
| EP | 574136 | 12/1993 |
| EP | 574239 | 12/1993 |
| EP | 605141 | 7/1994 |
| GB | 449546 | 6/1936 |
| SU | 230638 | 8/1978 |
| SU | 430747 | 8/1978 |
| WO | 93/22710 | 11/1993 |

OTHER PUBLICATIONS

Eastman Digital Sound Recording Film 2374™, Preliminary Data Sheets, 1990.

Clerc, *Photography Theory and Practice*, vol 3 Films, American Photographic Book Publishing Co. New York, 1970, pp 334–337.

Stroebel & Todd, *Dictionary of Contemporary Photography* Morgan & Morgan Inc, Dobbs Ferry, New York, p. 138, 1974.

* cited by examiner

*Primary Examiner*—Mark F. Huff
*Assistant Examiner*—Amanda C. Walke
(74) *Attorney, Agent, or Firm*—Andrew J. Anderson

(57) ABSTRACT

A black and white silver halide motion picture sound recording film is disclosed comprising a transparent support bearing at least one silver halide emulsion layer and an antihalation layer comprising filter dye which is incorporated in the form of a solid particle dispersion which is readily solubilized and removed or decolorized upon standard processing in the D-97 process as specified in Kodak publication H-24, so as to result in a minimum density of 0.07 or less. A method for printing an optical analog sound track in a motion picture color print film which comprises a support bearing light sensitive yellow, magenta, and cyan dye forming layers sensitized respectively to the blue, green, and red regions of the electromagnetic spectrum is disclosed, said process comprising: exposing an analog sound track in a black and white silver halide motion picture sound recording film in accordance with the invention and processing the exposed recording film to form a sound track negative image having a minimum density of 0.07 or less; printing the sound track negative image on the color motion picture print film by exposing the green sensitive layer while not substantially exposing the red sensitive layer; and processing the exposed color print film to form a silver plus magenta dye sound track image which may be read effectively with both an IR sensitive sound track reader and a red light sensitive sound track reader. Sound recording films which provide low Dmins in accordance with the invention require fewer lumens of light to print both analog and digital sound tracks. Films in accordance with the invention are magenta dye plus silver sound track enabling and provide a step toward the elimination of sound developer in the print processing operation. An unexpected performance feature of films in accordance with the invention is improved latitude in attaining excellent Dolby Digital Stereo sound performance by better matching the image spread between the sound negative and the print film.

27 Claims, No Drawings

SOUND RECORDING FILM

This application claims the benefit of Provisional application Ser. No. 60/129,719 filed Apr. 16, 1999.

TECHNICAL FIELD

This invention relates generally to the field of motion picture films, and in particular to a sound recording film and use thereof in recording analog and digital optical sound tracks onto a motion picture film.

BACKGROUND OF THE INVENTION

Motion picture print films, the film that is shown in movie theaters, commonly employ optical sound tracks along at least one edge of the film. The most common optical sound tracks presently in use are analog sound tracks of the "variable area" type wherein signals are recorded in the form of a varying ratio of opaque to relatively clear area along the sound track. During projection of the motion picture images, a light source illuminates the sound track and a photosensor senses the light passing through and modulated by the sound track to produce an audio signal that is sent to amplifiers of the theater sound system.

Digital sound tracks for motion picture films have been more recently introduced, wherein sound information is recorded in a digital format, e.g. comprising small data bit patterns on the film, typically between perforations of the motion picture film (e.g., Dolby™ Digital Stereo sound tracks) or along the film edge (e.g., Sony™ Dynamic Digital Sound sound tracks). U.S. Pat. Nos. 4,600,280 and 4,461,552, e.g., disclose methods in which digital audio is photographically recorded on motion picture film. U.S. Pat. No. 4,553,833 discloses a method for photographic recording of characters and symbols wherein a light emitting diode array is focused through converging lenses to focus small dot patterns on the film. European Patent Publication EP 0 574 239 discloses method and apparatus for photographically recording digital audio signals with error correction capability on more than one channel. European Patent Publication EP 0 574 136 discloses method and apparatus for recording digital information for clocking tracking error detection and correction, digital audio multichannel tracks and analog audio on a film media.

While digital sound tracks offer the advantage of high quality digital sound recording, they require the use of special sound decoding equipment during projection which all movie theaters may not have. Accordingly, conventional analog sound tracks are typically also included on a motion picture print film which is printed with a digital sound track so that such print film may be distributed to theaters which do not have equipment capable of decoding the digital sound track as well as those that do. Also, as digital sound tracks record information in the form of very small data bits, they may suffer from poor encoding and recording efficiency associated with the high precision demands of the recording process, as well as data loss due to scratches, etc. While various error detection and correction methods have been proposed for such digital sound tracks, analog sound tracks are still nevertheless desirably included on the print films as backups for the digital sound tracks during projection of a film.

In order to optimize the visual quality of the motion picture image as well as the sound quality of the sound track recorded on a motion picture print film, the motion picture and sound track are first typically captured or recorded on separate photosensitive films as negative images, and the resulting negatives are then printed in synchronization on the motion picture print film to form positive images. Because of very short exposure times which must be given to each separate picture, or frame, in capturing a motion picture image, a camera negative film employing relatively fast silver halide emulsions is typically used to record the motion picture images (e.g., Eastman Color Negative and Kodak Vision Color Negative films). In order to reproduce the wide ranges of colors and tones which may be found in various images, the camera film typically also has a relatively low contrast or gamma. Variable area analog sound tracks and digital sound tracks, however, are best recorded with high contrast, relatively slow speed black and white films (e.g., Eastman Sound Recording Films) in order to generate desired sharp images for the sound recording and minimize background noise generated by relatively high minimum densities typically associated with relatively fast films.

Typical black and white sound recording films designed for recording analog sound tracks comprise a relatively fine grain (e.g., grain size less than 0.35 micron) monodispersed silver halide emulsion, which provides the high contrast (e.g., contrast overall gradient greater than 3.7) desirable for recording the sound track with sharp edges. Sharpness is further enhanced in sound recording films by using halation protection. Halation protection is conventionally accomplished in current sound recording films by using a gray-tinted support, or by including an anti-halation layer containing permanently colored dyes, to yield a neutral density. The neutral density resulting from such halation protection increases the minimum density (Dmin) of current sound films by 0.2 density units.

Sound performance is ultimately measured on the print film because that is the vehicle for transmitting the sound film information to the amplifiers in the theater. Common sound systems for reading analog sound tracks incorporate a photodiode in the projector. The photodiode's radiant sensitivity peaks at approximately 800–950 nm (depending on the photodiode type), allowing it to detect predominantly infra-red (IR) radiation emitted by common tungsten lamps. In order to provide effective modulation of common projector illumination light, the optical analog sound track is typically formed in a color motion picture print film by printing the sound track with green and red light to expose the green- and red-light sensitive layers of the color print film, and then specially processing the optical analog sound track area of the print film differently from the picture image frame area such that a silver image is present in the sound track area of the film in addition to the formed magenta and cyan image dyes. The silver image has good detection in the IR, but the special treatment of the sound track area does add complexity to the photo-processing of the color print film. The photo-process is described in Kodak Publication No. H-24, The Kodak ECP-2B Process, Manual for Processing Eastman Color films, referenced above. Various other techniques are also known for retaining silver in the sound track area, e.g., as set forth in U.S. Pat. Nos. 2,220,178, 2,341,508, 2,763,550, 3,243,295, 3,705,799, 4,139,382.

In order to avoid the need for special development of the sound track in a color print film processing operation, it has been suggested to form silverless, dye-only sound tracks, to be used in combination with an appropriate decoding apparatus. For improved performance for such dye-only sound tracks, it may be preferable to record and develop the sound track in a single photosensitive layer of the print film, and recover the signal from the dye-only sound track using a narrow band (10–30 nm bandwidth) light source, the wavelength of which is chosen so as to coincide with the peak absorbance wavelength of the sound track dye. Where the cyan layer of the print film is used to record the sound track, e.g. a narrow band red light source would be used for reading the cyan dye. A red light emitting diode may be conveniently used for reading the cyan dye-only sound tracks, e.g. as has been proposed by Dolby Laboratories in an announcement at the Association of Cinema and Video Laboratories (ACVL) Jun. 1–3, 1995 convention at Lake Tahoe, Nev. The use of such relatively monochromatic light sources for the sound track reader in combination with a single layer dye sound track maximizes the relative optical density difference between the dyed areas and the undyed transparent areas of the sound track while maintaining high contrast. While a conventional tungsten light source may perform poorly with a dye only sound track due to the relatively low signal generated in the solar cell of the sound track reader resulting from the poor modulation of the tungsten light by the image dyes, the use of a narrow monochromatic light source eliminates the presence of unmodulated light outside the absorbance spectrum of the dye only sound track striking the solar cell, thereby improving the modulation signal generated by the solar cell.

To enable an industry conversion from the current predominant use of silver analog sound tracks to cyan dye-only analog sound tracks, theaters must change from IR readers to red readers for effective performance. During such conversion period, print films may be shown at different theaters which employ either type of reader to decode the sound signals present on the print films. Accordingly, it would be desirable to be able to provide print films with sound tracks which may be read effectively with either of such readers during the conversion period. Once most theaters have changed to a red-reader, the film industry may then employ a cyan dye-only sound track in color print films, which can be read effectively with a red-reader.

Conventional silver sound tracks on color print films comprise magenta dye and cyan dye in addition to silver density as both the red- and green-light sensitive layers of the print film are exposed in the sound track region. The blue light-sensitive, yellow dye-forming layer of the color print film is typically not exposed when printing the sound track, as it generally results in higher image spread than the other light-sensitive layers. Sound distortion in a printed sound track is at its minimum when the image spread of the print film exactly cancels out the image spread of the sound recording negative film. Image spread is a function of density. While silver provides an essentially neutral density over the visible and IR spectrum, the density of a conventional printed silver sound track is wavelength dependent over the visible spectrum due to the additional presence of cyan and magenta dyes. Since density, and therefore image spread, is wavelength dependent for the conventional silver sound track, reading the sound track with different light wavelengths will produce different sound distortion and accordingly result in variable sound quality. The IR reader, e.g., using white light source, is most sensitive from 800 nm to 1000 nm, where only silver density is present. A red reader, using red light source, is most sensitive around 660 nm, where there is cyan dye density in addition to silver density in the conventional print sound track. Therefore, the sound distortion result of a conventional silver sound track read by an IR reader will not be the same as for the same track read by a red reader.

To have a sound track that reads well on both an IR reader and a red reader, the sound track density at 660 nm should be very close to the density at 800–1000 nm. This can be accomplished by minimizing the cyan dye density, e.g., by printing the sound track with only green light exposure. While magenta dye will also be present in such a sound track, the magenta dye will not significantly change the densities read at 660 nm relative to that at 800–1000 nm. Since silver is only produced in the green-light sensitive layer, however, in order to provide desired density levels to provide optimum sound quality, a higher intensity printer light source or longer exposures are required with current sound recording films, each of which is not desired in the art.

In digital sound tracks, photo-processing of the print film yields dye images which are decoded in the theaters with either green or red readers. There are optimum print dye densities that correspond to sound negative silver densities that will enable the best possible sound performance. In many theaters, digital sound is preferred and analog sound serves as a backup, in the event that the digital sound track cannot be read.

Different metrics are employed to assess the performance of the various sound tracks. Performance of analog sound tracks is measured by a metric termed cross-modulation. Cross-modulation (X-mod) measures the ability of the image distortion, present as image spread, in the sound negative to be cancelled by the image spread in the print film. The closer to exact the cancellation, the truer the sound representation. Dolby Digital Stereo employs DQI (Dolby Quality Index) as the metric to assess the quality of Dolby sound on the print film. The performance rating is numerical from 0–100. A higher number is indicative of better performance. The performance rating system for Sony assigns a letter grade with A representing the best performance. All sound systems incorporate a variable dependent on image spread to rate the quality of the sound.

Accordingly, it would be desirable to provide a sound recording film which would enable the production of print films with analog silver sound tracks which may be read effectively with either an IR reader or a red reader, without requiring excessive exposure levels during printing of the sound track. It would be further desirable to provide such a sound recording film which would also enable improved digital sound track recording performance.

SUMMARY OF THE INVENTION

In accordance with one embodiment of the invention, a black and white silver halide motion picture sound recording film is disclosed comprising a transparent support bearing at least one silver halide emulsion layer and an antihalation layer comprising filter dye which is incorporated in the form of a solid particle dispersion which is readily solubilized and removed or decolorized upon standard processing in the D-97 process as specified in Kodak publication H-24, so as to result in a minimum density of 0.07 or less.

In accordance with another embodiment of the invention, a method for printing an optical analog sound track in a motion picture color print film which comprises a support bearing light sensitive yellow, magenta, and cyan dye forming layers sensitized respectively to the blue, green, and red regions of the electromagnetic spectrum is disclosed, said process comprising: exposing an analog sound track in a black and white silver halide motion picture sound recording film in accordance with claim 1 and processing the exposed recording film to form a sound track negative image having a minimum density of 0.07 or less; printing the sound track negative image on the color motion picture print film by exposing the green sensitive layer while not substantially exposing the red sensitive layer; and processing the exposed color print film to form a silver plus magenta dye sound track image which may be read effectively with both an IR sensitive sound track reader and a red light sensitive sound track reader.

Further embodiments of the invention disclosed include methods for printing dye-only optical analog and digital sound track in a motion picture color print film which comprises a support bearing light sensitive yellow, magenta, and cyan dye forming layers sensitized respectively to the blue, green, and red regions of the electromagnetic spectrum is disclosed, said processes comprising: exposing an analog or digital sound track in a black and white silver halide motion picture sound recording film in accordance with claim 1 and processing the exposed recording film to form a sound track negative image having a minimum density of 0.07 or less; printing the sound track negative image on the color motion picture print film by exposing only one of the green or red sensitive layer while not substantially exposing the other; and processing the exposed color print film to form a magenta or cyan-only dye sound track image which may be read effectively with a green light sensitive sound track reader or a red light sensitive sound track reader.

ADVANTAGEOUS EFFECT OF THE INVENTION

Sound recording films which provide low Dmins in accordance with the invention require fewer lumens of light to print both analog and digital sound tracks. Films in accordance with the invention are magenta dye plus silver sound track enabling and provide a step toward the elimination of sound developer in the print processing operation. An unexpected performance feature of films in accordance with the invention is improved latitude in attaining excellent Dolby Digital Stereo sound performance by better matching the image spread between the sound negative and the print film.

The advantages that this invention provides relative to the use of current sound recording films are as follows: 1) Less light is required to expose analog and digital sound tracks meaning that fewer exposure set-ups will require modifications to achieve excellent magenta dye track performance. 2) The operating window for Dolby Digital Stereo sound negative-to-print exposure is increased via enlarging the acceptable print density space to achieve high DQI performance. These advantages are obtained by substantially eliminating the traditional 0.2 units of minimum density incorporated in conventional sound recording films, which density increases the requirements for exposure time or intensity needed to achieve a print density that enables optimal sound performance when printing the sound negative information to the color print film.

DETAILED DESCRIPTION

In the following discussion of suitable materials for use in the sound recording films and sound recording methods of this invention, reference will be made to *Research Disclosure*, December 1978, Item 17643, and *Research Disclosure*, December 1989, Item No. 308119, both published by Kenneth Mason Publications, Ltd., Dudley Annex, 12a North Street, Emsworth, Hampshire P0107DQ, ENGLAND, the disclosures of which are incorporated herein by reference. These publications will be identified hereafter by the term "Research Disclosure". A reference to a particular section in "Research Disclosure" corresponds to the appropriate section in each of the above-identified Research Disclosures. The elements of the invention can comprise emulsions and addenda described in these publications and publications referenced in these publications.

Motion picture sound recording films in accordance with the invention comprise at least one black and white silver halide emulsion and an antihalation layer coated on a transparent support. In a preferred embodiment of the invention, the support will have less than 0.03 density units in the green and red regions of the color spectrum. Preferred support materials for the films comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate).

The silver halide emulsion layers may include any type of silver halide grains. Such grains can be comprised of, e.g., silver bromide, silver chloride, silver iodide, silver bromochloride, silver bromoiodide, silver iodochloride, silver iodobromide, silver chlorobromoiodide or mixtures thereof; and can be of various shapes and size. In order to provide a high contrast film (e.g., contrast overall gradients preferably greater than 3.7, more preferably greater than 3.8, most preferably greater than 3.9) wherein the overall gradient is defined as the slope of the straight line portion of a D logE characteristic curve between 0.3 and 2.3 above minimum density), sound recording film cubical emulsion layers typically comprise fine monodisperse silver halide grains having a coefficient of variation ("C.O.V.") of grain diameter of less than 55%, preferably less than 45% and most preferably less than 35%, wherein C.O.V. is defined as the standard deviation (sigma) of grain diameter for the emulsion divided by the mean grain diameter, times 100. Silver laydowns in the emulsion layers should be sufficient to provide maximum densities of at least 3.4, preferably at least 3.6.

According to common analog sound track recording procedures, sound recording films are exposed to tungsten light in a sound recorder to capture the latent image of an analog sound pattern. The typical equivalent shutter speeds of commercial analog sound track recorders are on the order of $10^{-3}$ second exposure time. Typical digital recording exposure times using lasers or light emitting diodes range from $10^{-3}$ second to $10^{-4}$ second or less. In order to enable efficient capture of both analog sound tracks recorded with tungsten light as well as digital sound tracks, in a preferred embodiment of the invention emulsions having a reciprocity speed differential of less than 0.25 logE, more preferably less than 0.2 logE, and most preferably less than 0.1 logE over a range of exposure times from 10-3 to 10-4 second, wherein the reciprocity speed differential is measured at a density of 2.5. Reciprocity performance may be achieved using known techniques such as through use of dopants and/or chemical sensitization.

Dopants, such as compounds of copper, thallium, lead, bismuth, cadmium and Group VIII noble metals, can be present during preparation of silver halide grains employed in emulsion layers of the sound recording film. Possible dopants also include transition metal complexes as described in U.S. Pat. Nos. 4,981,781, 4,937,180, and 4,933,272.

Emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions are preferably negative-working emulsions such as surface-sensitive emulsions or unfogged internal latent image-forming emulsions.

The silver halide grains of the emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*. Item 308119, cited above, Section III. Silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in U.S. Pat. No. 2,430,558 and other references cited in *Research Disclosure*, Item 308119, cited above, Section IV. The sound recording film emulsions may be spectrally sensitized with sensitizing dyes providing light sensitivity below or above 600 nm. In accordance with a preferred embodiment of the invention, the sound recording film emulsions are effectively spectrally sensitized both below and above 600 nm. This may be accomplished with a sensitizing dye providing a broad sensitivity peak for the sensitized emulsion which spans substantial portions of both the green (e.g., 500–600 nm) and red (e.g., 600–750) regions of the spectrum, or through use of multiple sensitizing dyes providing peak sensitivities both above and below 600 nm. In a particularly preferred embodiment, the sound recording film emulsions are spectrally sensitized with a first green spectral sensitizing dye providing a peak sensitivity at less than or equal to 600 nm and a second red spectral sensitizing dye providing a peak sensitivity above 600 nm. Such first and second dyes are preferably used together to spectrally sensitize a single silver halide emulsion, but may alternatively be used to sensitize separate emulsions, which may then be combined and coated in a single layer or coated in separate layers.

In a preferred embodiment of the invention, the sound recording film is spectrally sensitized with green and red spectral sensitizing dyes providing peak sensitivities at about 580 nm and at about 670 nm. In further embodiments of the invention, the sound recording film may also be sensitized to the infrared and/or ultraviolet regions of the electromagnetic spectrum.

The sound recording film of the invention is preferably spectrally sensitized so as to require less than 0.23 erg/cm$^2$, more preferably less than 0.21 erg/cm$^2$, and most preferably less than 0.2 erg/cm$^2$ of energy at wavelengths of 580 nm and 670 nm, and more preferably for all wavelengths throughout the green and red regions of the electromagnetic spectrum, to produce a visual density of 0.40 after exposure and standard processing in the D-97 process as specified in the Kodak Publication H-24 titles "Manual for processing Eastman Motion Picture Film Module 15", the disclosure of which is incorporated by reference. As disclosed therein, standard processing steps for processing black and white films with Kodak D-97 Developer comprise development, wash or stop, and fix steps. The development step is especially important to the control of contrast and image density. Standard development times are disclosed as being dependent on type of film being processed. Standard development time for processing black and white sound recording films with Kodak D-97 Developer is 4:00 minutes at 23.9±0.3 ° C. The composition of the standard D-97 Developer formulation, as set forth in Table 15-6 of Kodak Publication H-24, is as follows:

KODAK Developer D-97 (Positive)

| Constituent | D-97 (tank) | D-97R (replenisher) |
|---|---|---|
| Water, about 125° F. (50° C.) | 750 mL | 750 mL |
| Quadrofos or Calgon* | 1.0 g** | 1.0 g** |
| KODAK ELON Developing Agent | 0.5 g | 0.7 g |
| KODAK Sodium Sulfite (Anhydrous) | 40.0 g | 70.0 g |
| KODAK Hydroquinone | 3.0 g | 11.0 g |
| KODAK Sodium Carbonate (Monohydrated) | 20.0 g | 20.0 g |
| KODAK Potassium Bromide (Anhydrous) | 2.0 g | 0.15 g |
| or Sodium Bromide | 1.75 g | 0.13 g |
| KODAK Sodium Hydroxide | — | 2.0 g |
| Water to make | 1.00 L | 1.00 L |
| pH at 80.6° F. (27° C.) | 10.15 ± 0.05 | 10.25 ± 0.05 |
| Specific Gravity at 80.6° F. (27° C.) | 1.052 ± 0.003 | 1.083 ± 0.003 |

*Both Quadrofos and Calgon (Calgon, Inc.) are sequestering agents.
**May need to be adjusted, depending on water condition.

In order to be able to produce desirably high maximum densities with conventional exposure and processing, the sound recording film of the invention also is preferably spectrally sensitized so as to require less than 1.9 erg/cm$^2$, more preferably less than 1.7 erg/cm$^2$, and most preferably less than 1.6 erg/cm$^2$ of energy at wavelengths of 580 nm and 670 nm, and more preferably for all wavelengths throughout the green and red regions of the electromagnetic spectrum, to produce a visual density of 3.75 after exposure and standard processing in the D-97 process.

It is further preferable that the sound recording film of the invention be substantially panchromatically sensitive from about 400 nm to at least 670 nm across the visible spectrum, so as to be able to be used with any wavelength exposing source within such range. Blue sensitizing dyes may be used along with green and red dyes to provide pansensitization, or an innately blue sensitive emulsion may be used along with a green and red sensitizing dye or dyes, or combinations of individually spectrally sensitized emulsions and innately sensitized emulsions may be used. For the purposes of this invention, a sound recording film is said to be substantially panchromatically sensitive across a wavelength range when it satisfies the above energy requirements to produce a density of 0.4 for all wavelengths within the range. Such panchromatically sensitive films also preferably satisfy the above energy requirements to produce a density of 3.75 for all wavelengths within the range.

Suitable vehicles for the emulsion layer and other layers of elements of this invention include hydrophilic colloids such as described in *Research Disclosure*. Item 308119, Section IX and the publications cited therein. In preferred embodiments of the invention, the hydrophilic colloid is gelatin. This may be any gelatin or modified gelatin such as acetylated gelatin, phthalated lo gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly (vinylacetate/vinylalcohol), hydroxyethyl cellulose, poly (acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Sound recording films in accordance with the invention comprise an antihalation layer comprising filter dyes which are incorporated into the photographic element in the form of solid particle dispersions which are readily solubilized and removed or decolorized upon standard processing in the D-97 process as referenced above, so as to result in a minimum density, Dmin, of 0.07 or less. Preferred filter dyes that can be used in the form of solid particle dispersions include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D—(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxonol dye or ammonium salts thereof The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D—(A)_y]—X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables 1 to X of WO 88/04794, formulas (I) to (VII) of EP 0 456 163 A2, formula (II) of EP 0 594 973, and Tables I to XVI of U.S. Pat. No. 4,940,654 incorporated by reference above.

It is especially preferable to include a yellow-colored, blue-light absorbing filter dye in an antihalation layer in combination with a cyan-colored, red-light absorbing barbituric acid oxonol filter dye, such as the dyes disclosed for use in the antihalation layers of the photographic elements described in U.S. Pat. Nos. 4,770,984 and 5,723,272, the disclosures of which are hereby incorporated by reference herein. Exemplary blue-light absorbing dyes include the merostyryl dyes of formula (I) and monomethine oxonol dyes of formula (II) of U.S. Pat. No. 4,770,984. Additional preferred yellow dyes include yellow arylidene dyes of the above referenced solid particle dye patents. Preferred barbituric acid oxonol filter dyes include those of formula (I) of U.S. Pat. No. 5,723,272.

In preferred embodiments of the invention, the antihalation layer is a hydrophilic colloid layer, the hydrophilic colloid preferably being gelatin. This may be any gelatin or modified gelatin, or another water-soluble polymer or copolymer or mixtures thereof with gelatin, as referenced above. The antihalation layer is preferably present between the silver halide emulsion layer and the transparent support of the sound recording film.

For effective antihalation protection, antihalation filter dyes are preferably incorporated into the antihalation layers of the invention at coverages to provide optical densities of from about 0.2 to 1.5 across the visible spectrum prior to processing and removal. In preferred embodiments of the invention, a blue light absorbing (yellow colored) merostyryl, monomethine oxonol and/or arylidene filter dye is used at a combined coverage of from about 10–100 mg/m$^2$ (more preferably 10–50 mg/m$^2$), and a red light absorbing barbituric acid oxonol filter dye is used at a coverage from about 10 to 200 mg/m$^2$ (more preferably 20–100 mg/m$^2$).

In a preferred embodiment of the invention, an antistatic layer is coated on the backside of the film support, opposite to the silver halide emulsion layer. Any antistatic materials such as those previously suggested for use with photographic elements may be used. Such materials include, e.g., ionic polymers, electronic conducting non-ionic polymers, and metal halides of metal oxides in polymer binders.

Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $A1_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by; reference. Preferred metal oxides are antimony doped tin oxide, aluminum doped zinc oxide, and niobium doped titanium oxide, as these oxides have been found to provide acceptable performance characteristics in demanding environments. Particular preferred metal oxides for use in this invention are antimony-doped tin oxide and vanadium pentoxide which provide good resistance to static discharge.

An overcoat layer may be present above the antistatic layer. This overcoat would contain matting agents and lubricants in a polymeric binder to minimize scratching and enable good winding performance.

The sound recording film elements of the invention can further contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, anti stain agents and image dye stabilizers (*Research Disclosure*, Section VII, paragraphs I and J), light absorbing and scattering materials (*Research Disclosure*, Section VIII), hardeners (*Research Disclosure*, Section X), polyalkyleneoxide and other surfactants as described in U.S. Pat. No. 5,236,817, coating aids (*Research Disclosure*, Section M), plasticizers and lubricants (*Research Disclosure*, Section XII), anti static agents (*Research Disclosure*, Section XIII), matting agents (*Research Disclosure*, Section XII and XVI) and development modifiers (*Research Disclosure*, Section XX.

An overcoat layer is preferably provided over the silver halide emulsion layer(s) of the sound recording film of the invention. Such overcoat may include lubricants and matting agents to minimize scratch susceptibility of the sound negative to scratches and handling damage that may impact the digital decoding processes described in the art which require digital error correction or switching to analog tracks for continuous sound playback. A diverse variety of lubricants can be used to provide appropriate lubricity. Preferred lubricates include those synthesized via the transesterification of methyl myristrate, methyl palmitate, methyl stearate, diethylene glycol and/or triethylene glycol, and commercially available silicon based lubricants such as Dow Corning 200, preferably as a mixture with Tergitol 15-S-5 or Synthetic Spermafol. The preferred range of active ingredient for best preventing handling scratches that may impact the decoding of digital audio sound tracks is from about 0.2 to 1 $mg/m^2$ in the overcoat layer. Such active ingredients are preferably coated in a hydrophilic colloid layer, such as a gelatin overcoat layer. The silver halide and overcoat layers are preferably hardened with conventional gelatin hardeners.

If desired, the recording films can be used in conjunction with an applied magnetic layer as described in U.S. Pat. Nos. 4,279,945 and 4,302,523 and *Research Disclosure*, November 1992, Item 34390 published by Kenneth Mason Publications, Ltd., Dudley House, 12 North Street, Emsworth, Hampshire P0107DQ, ENGLAND.

In accordance with certain embodiments of the invention, multiple digital sound tracks may be recorded using substantially monochromatic exposing devices such as lasers or light emitting diodes operating at wavelengths both above and below 600 nm, as well as analog sound tracks using a white light exposing source or one of the monochromatic light sources. Such exposures may be performed in accordance with conventional digital and analog recording equipment. Preferably, the various exposing devices may be arranged so that the sound recording film may be transported in a single loop in sequence through the recorders, and selectively exposed on different portions of the film through use of filters, masks, etc. The exposed sound negative may then be processed in a black and white developer solution, washed, fixed, and dried to form a silver archival negative record of the sound tracks, using a process as described in Kodak Publication H-24 referenced above. The sound negative may then be printed along with a motion picture visual negative on a motion picture print film, such as Eastman Color Print Film 5386.

In motion picture color printing, there are usually three records to record simultaneously in the image area frame region of a print film, i.e., red, green and blue. The original image record to be reproduced is preferably an image composed of sub-records having radiation patterns in different regions of the spectrum. Typically it will be a multicolor record composed of sub-records formed from cyan, magenta and yellow dyes. The principle by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure* referenced above. Materials in which such images are formed can be exposed to an original scene in a camera, or can be duplicates formed from such camera origination materials, such as records formed in color negative intermediate films such as those identified by the tradenames Eastman Color Intermediate Films 2244, 5244 and 7244. The peak absorptions for such films are typically in the blue region of the spectrum at about 440 nm, in the green region of the spectrum at about 540 nm, and in the red region of the spectrum at about 680 nm.

Motion picture color print films typically comprise a support bearing light sensitive yellow, magenta, and cyan dye forming layers sensitized respectively to the blue (approx. 380–500 nm), green (approx. 500–600 nm), and red (approx. 600–760 nm) regions of the electromagnetic spectrum. Such materials are described in the *Research Disclosure* publications cited above. Such light sensitive materials may also be sensitive to one or more regions of the electromagnetic spectrum outside the visible, such as the infra red region of the spectrum. In most color photographic systems, color-forming couplers are incorporated in the light-sensitive photographic emulsion layers so that during development, it is available in the emulsion layer to react with the color developing agent that is oxidized by silver image development. Diffusible couplers are used in color developer solutions. Non-diffusing couplers are incorporated in photographic emulsion layers. When the dye image formed is to be used in situ, couplers are selected which form non-diff-using dyes. Color photographic systems can also be used to produce black-and-white images from non-diffusing couplers as described by Edwards et al in International Publication No. WO 93/012465.

In accordance with certain embodiments of the invention, selective light-sensitive layers of the color print film may be exposed when printing a sound track negative formed in a sound recording film in accordance with the invention on the print film. In a preferred embodiment, the low minimum density of the sound recording film allows for printing practical sound track densities in a single light-sensitive layer of the print film with out the need for extreme exposure times or intensities. The green light-sensitive layer, e.g., may be selectively exposed and processed to form a silver plus magenta dye analog sound track image which may be read effectively with both an IR sensitive sound track reader and a red light sensitive sound track reader. Additionally, analog and digital dye-only sound tracks may be formed in selective light-sensitive layers of the print film which provide improved sound quality performance over wider optimum density operating windows.

EXAMPLES

A cubic bromoiodide emulsion prepared to have a halide ratio of 97 to 3, bromide to iodide, and possessing a median grain size of 0.28 microns with a standard deviation of 0.095 as estimated via disc centrifuge particle sizing method was chemically sensitized using sodium aurous dithiosulfate dihydrate at 0.059 g/mole silver, potassium selenocyanate at 0.0028 kg/mole silver and sodium thiosulfate pentahydrate at 13.2 g/mole silver. The emulsion was then spectrally sensitized with green spectral sensitizing dyes GSD-1 at 0.089 g/mole silver (peak. sensitivity at 580nm) and GSD-2 at 0.178 g/mole silver (peak sensitivity at 550nm), and red spectral sensitizing dye RSD-1 at 0.060 g/mole silver (peak sensitivity at 670nm).

GSD-1

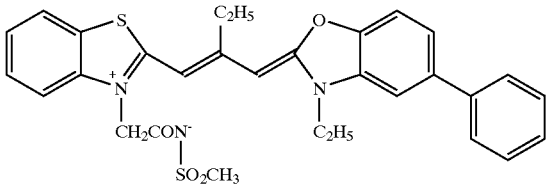

-continued

GSD-2

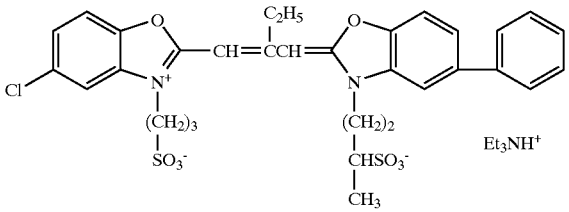

RSD-1

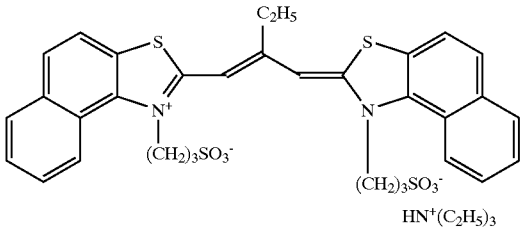

A photosensitive layer containing the above-described silver halide emulsion was coated over an antihalation layer on a clear, 4.7 mil support. The support contained four elements: 1) a clear poly(ethylene terephthalate) Estarm base, 2) a gel sub-coat to allow adhesion of the sensitized structure, 3) an antistatic layer on the side of the support opposite to the emulsion layer, with a photographic-process-surviving antistatic similarly as described in Example 5 of U.S. Pat. No. 5,723,272, and 4) a protective polyurethane layer that served as the backside of the support. This polyurethane layer contained polymethylmethacrylate matte beads (as described in US Pat. No. 5,679,505 and 5,563,226) at 2.70 mg/m$^2$.

The sensitized layer contained the bromoiodide emulsion at a silver laydown of 2606 mg/m$^2$ with a useful range of 23 00 mg/m$^2$ to 3000 mg/M$^2$. Also included in this layer were water soluble absorber dyes A at 8.1 mg/M$^2$ and B at 120 mg/r$^2$. An overcoat layer containing polymethylmethacrylate matte beads at 8.6 mg/M$^2$ was coated above the sensitized emulsion layer.

The antihalation layer was positioned between the support and the sensitized emulsion layer on the support's gel sub-coat and contained solid particle dispersions of filter dyes that are rendered colorless upon photographic processing. The solid particle filter dyes used in this example are barbituric acid oxonol cyan dye C at 62.43 mg/M$^2$ and yellow filter dye D at 21.53 mg/ft$^2$. The solid particle dispersions were obtained by milling the dyes in a manner similar to that described in Example 1 of U.S. Pat. No. 5,723,272. The dyes at the coverages employed were effective to provide greater than 0.2 density units before photographic processing.

Dye A

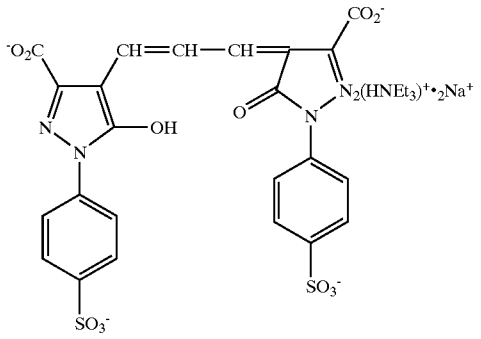

Dye B

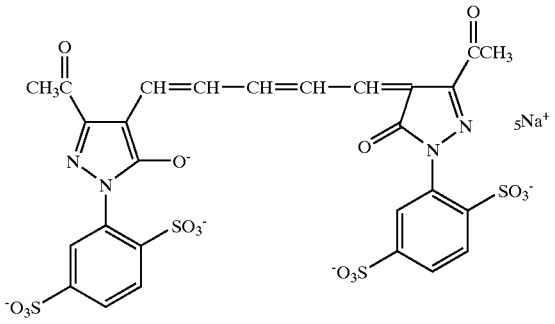

Dye C

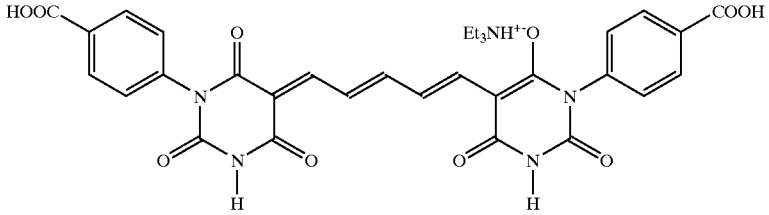

Dye D

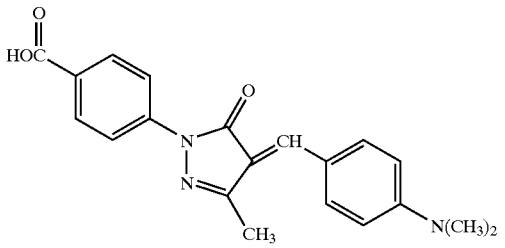

The above described coated film in accordance with the invention, and a sample of a commercial sound film (Kodak Sound Film 2374, referred to as the reference) were given three exposures with white, green and red illumninants to simulate the analog, Dolby and Sony exposures, respectively, typically seen in practical applications. The illuminants are described below:

| Illuminant | Additional Filter | Exposure Time |
|---|---|---|
| White Light (color temp = 2850K) | none | 1/1000 sec |
| Green Light (Xenon with 580 nm Bandpass Filter) | none | <100 micro sec |
| Red Light (Tungsten with 660 nm Bandpass Filter) | 0.2 ND | <100 micro sec |

The exposed samples were processed in the D-97 photographic process as described in Kodak Publication H-24 entitled, "Manual for Processing Eastman Motion Picture Film Module I 5". The resulting sensitometric responses are summarized below, where Dmin and Dmax are the minimum and maximum densities of the film after processing, speed is defined as 100(1 -logE) at a density of 2.5, and overall gradient (OG) is defined as the slope of the DLog E curve between densities of 0.3 and 2.3 above Dmin.

| Sample | Illuminant | Dmin | Speed | OG | Dmax |
|---|---|---|---|---|---|
| Reference | White Light | 0.256 | 140 | 3.95 | 4.39 |
| Invention | White Light | 0.047 | 128 | 3.79 | 4.09 |
| Reference | Green Light | 0.252 | 117 | 4.32 | 4.37 |
| Invention | Green Light | 0.050 | 116 | 4.13 | 4.05 |
| Reference | Red Light | 0.253 | 66 | 3.44 | 4.04 |
| Invention | Red Light | 0.049 | 55 | 3.38 | 3.81 |

The above data demonstrates that sound recording films in accordance with the invention which employ solid particle dispersions of process removable or decolorizable dyes present at levels sufficient to provide sufficient antihalation protection exhibit desirably low minimum densities after photographic processing.

Analog and digital sound tracks were recorded in sound recording films in accordance with the invention, and subsequently printed on a motion picture color print film. The analog sound track was printed in the green light-sensitive layer only of the print film within practical exposure levels, and the print film was processed to obtain a silver-plus-magenta dye sound track image which could be read effectively with both an IR sound track reader as well as a red-light sound track reader. The digital sound tracks were printed in either the green light-sensitive layer or the red light-sensitive layer of the print film, and the exposed print films were processed to yield dye-only digital sound track images. The low Dmin of the sound recording film enabled improved latitude in attaining excellent sound performance for the digital sound tracks by better matching the image spread between the sound negative and the print film.

This invention has been described in detail with particular reference to preferred embodiments thereof It will be understood that variations and modifications can be made within the spirit and scope of the invention.

We claim:

1. A black and white silver halide motion picture sound recording film comprising a transparent support bearing at least one silver halide emulsion layer and an antihalation layer comprising filter dye which is incorporated in the form of a solid particle dispersion which is readily solubilized and removed or decolorized upon standard processing in the D-97 process as specified in Kodak publication H-24, so as to result in a minimum density of 0.07 or less.

2. A sound recording film according to claim 1, wherein the filter dye incorporated in the form of a solid particle dispersion is substantially insoluble at aqueous coating pH's of less than 7, and is readily soluble or decolorizable in aqueous photographic processing solutions at pH of 8 or above, so as to be removed from or decolorized in a photographic element upon photographic processing.

3. A sound recording film according to claim 2, wherein the filter dye is of the formula:

$$D—(X)_n$$

where D represents a residue of a substantially insoluble compound having a chromophoric group, X represents a group having an ionizable proton bonded to D either directly or through a bivalent bonding group, and n is 1–7.

4. A sound recording film according to claim 3, wherein D represents an oxonol dye, merocyanine dye, cyanine dye, arylidene dye, azomethine dye, triphenylmethane dye, azo dyes, or anthraquinone dye.

5. A sound recording film according to claim 3, wherein X represents a group which has a pKa (acid dissociation constant) value measured in a mixed solvent of water and ethanol at 1:1 volume ratio within the range of 4 to 11.

6. A sound recording film according to claim 3, wherein X represents a carboxyl group, a sulfonamido group, a sulfamoyl group, a sulfonylcarbamoyl group, a carbonylsulfamoyl group, a hydroxy group, or the enol group of a oxonol dye or ammonium salts thereof.

7. A sound recording film according to claim 3, wherein the filter dye has a log P hydrophobicity parameter of from 0–6 in its non-ionized state.

8. A sound recording film according to claim 1, wherein the antihalation layer comprises a yellow-colored, blue-light absorbing filter dye in combination with a cyan-colored, red-light absorbing filter dye.

9. A sound recording film according to claim 8, wherein the blue-light absorbing filter dye is a merostyryl, monomethine oxonol, or yellow arylidene dye.

10. A sound recording film according to claim 8, wherein the red-light absorbing filter dye is a barbituric acid oxonol filter dye.

11. A sound recording film according to claim 8, wherein the antihalation filter dyes are incorporated into the antihalation layer at coverages to provide optical densities of from about 0.2 to 1.5 across the visible spectrum prior to processing and removal.

12. A sound recording film according to claim 8, wherein blue light absorbing filter dyes are present in the antihalation layer at a combined coverage of from about 10–100 mg/m$^2$, and red light absorbing filter dyes are present at a combined coverage from about 10 to 200 mg/m$^2$.

13. A sound recording film according to claim 12, wherein blue light absorbing filter dyes are present in the antihalation layer at a combined coverage of from about 10–50 mg/m$^2$, and red light absorbing filter dyes are present at a combined coverage from about 20–100 mg/m$^2$.

14. A sound recording film according to claim 1, wherein antihalation filter dyes are incorporated into the antihalation layer at coverages to provide optical densities of from about 0.2 to 1.5 across the visible spectrum prior to processing and removal.

15. A sound recording film according to claim 1, wherein said film is spectrally sensitized both above and below 600 nm.

16. A sound recording film according to claim 1, wherein said film is spectrally sensitized with a first sensitizing dye providing a peak sensitivity at less than or equal to 600 nm and a second sensitizing dye providing a peak sensitivity above 600 nm.

17. A sound recording film according to claim 1, wherein said film comprises a silver halide emulsion comprising silver halide grains having an average grain size of less than 0.35 microns.

18. A sound recording film according to claim 1, wherein said film comprises a silver halide emulsion comprising silver halide grains having an average grain size of less than 0.31 microns.

19. A sound recording film according to claim 1, wherein said film comprises a silver halide emulsion comprising silver halide grains having an average grain size of less than 0.29 microns.

20. A sound recording film according to claim 1, wherein said silver halide emulsion layer comprises monodispersed silver halide grains having a coefficient of variation of grain size of less than 55%.

21. A sound recording film according to claim 1, wherein said film has a reciprocity speed differential of less than 0.25 logE over a range of exposure times from $10^{-3}$ to $10^{-4}$ second, wherein the reciprocity speed differential is measured at a density of 2.5.

22. A sound recording film according to claim 1, wherein said film is spectrally sensitized with a green spectral sensitizing dye and a red spectral sensitizing dye.

23. A sound recording film according to claim 1, wherein said film exhibits a maximum density of at least 3.7 after exposure with white light, 580 nm light, or 670 nm light and standard processing.

24. A method for printing an optical analog sound track recorded in a black and white silver halide motion picture sound recording film in accordance with claim 1 on a motion picture color print film which comprises a support bearing light sensitive yellow, magenta, and cyan dye forming layers sensitized respectively to the blue, green, and red regions of the electromagnetic spectrum, said method comprising:

exposing an analog sound track in a black and white silver halide motion picture sound recording film in accordance with claim 1 and processing the exposed recording film to form a sound track negative image having a minimum density of 0.07 or less;

printing the sound track negative image on the color motion picture print film by exposing the green sensitive layer while not substantially exposing the red sensitive layer; and processing the exposed color print film to form a silver plus magenta dye sound track image which may be read effectively with both an IR sensitive sound track reader and a red light sensitive sound track reader.

25. A method for printing a digital sound track recorded in a black and white silver halide motion picture sound recording film in accordance with claim 1 on a motion picture color print film which comprises a support bearing light sensitive yellow, magenta, and cyan dye forming layers sensitized respectively to the blue, green, and red regions of the electromagnetic spectrum, said method comprising:

exposing a digital sound track in a black and white silver halide motion picture sound recording film in accordance with claim 1 and processing the exposed recording film to form a sound track negative image having a minimum density of 0.07 or less;

printing the sound track negative image on the color motion picture print film; and processing the exposed color print film to form a dye-only digital sound track image which may be read effectively with a digital sound track reader.

26. A method for printing an optical analog sound track recorded in a black and white silver halide motion picture sound recording film in accordance with claim 1 on a motion picture color print film which comprises a support bearing light sensitive yellow, magenta, and cyan dye forming layers sensitized respectively to the blue, green, and red regions of the electromagnetic spectrum, said method comprising:

exposing an analog sound track in a black and white silver halide motion picture sound recording film in accordance with claim 1 and processing the exposed recording film to form a sound track negative image having a minimum density of 0.07 or less;

printing the sound track negative image on the color motion picture print film by exposing the red sensitive layer while not substantially exposing the green sensitive layer; and processing the exposed color print film to form a cyan dye-only sound track image which may be read effectively with a red light sensitive sound track reader.

27. A method for printing an analog sound track recorded in a black and white silver halide motion picture sound recording film in accordance with claim 1 on a motion picture color print film which comprises a support bearing light sensitive yellow, magenta, and cyan dye forming layers sensitized respectively to the blue, green, and red regions of the electromagnetic spectrum, said method comprising:

exposing an analog sound track in a black and white silver halide motion picture sound recording film in accordance with claim 1 and processing the exposed recording film to form a sound track negative image having a minimum density of 0.07 or less;

printing the sound track negative image on the color motion picture print film by exposing the green sensitive layer while not substantially exposing the red sensitive layer; and processing the exposed color print film to form a magenta dye-only sound track image which may be read effectively with a green-light sensitive sound track reader.

* * * * *